United States Patent [19]

Sydor et al.

[11] Patent Number: 4,739,765

[45] Date of Patent: Apr. 26, 1988

[54] ARCH SUPPORT

[75] Inventors: Frank Sydor; Peter Glogowski, both of Mississauga, Canada

[73] Assignee: Bio Balance Orthotics Inc., Mississauga, Canada

[21] Appl. No.: 879,005

[22] Filed: Jun. 26, 1986

[30] Foreign Application Priority Data

Jun. 28, 1985 [CA] Canada ..... 486011

[51] Int. Cl.[4] ..... A61F 5/14

[52] U.S. Cl. ..... 128/615; 128/621

[58] Field of Search ..... 128/586, 595, 607, 615, 128/621

[56] References Cited

U.S. PATENT DOCUMENTS

| | | | |
|---|---|---|---|
| 865,836 | 9/1907 | Wedekind | 128/595 |
| 1,272,994 | 7/1918 | Phelps | 128/615 |
| 1,685,827 | 10/1928 | Saklad | 128/586 |
| 2,150,057 | 3/1939 | Fisch | 128/615 |
| 2,219,355 | 10/1940 | Donovan | 128/586 |
| 2,978,818 | 4/1961 | Baumann | 128/586 |
| 3,543,765 | 12/1970 | Alzner | 128/615 X |
| 4,510,700 | 4/1985 | Brown | 128/595 X |

FOREIGN PATENT DOCUMENTS

| | | | |
|---|---|---|---|
| 1441362 | 1/1969 | Fed. Rep. of Germany | 128/595 |
| 480304 | 2/1938 | United Kingdom | 128/586 |

*Primary Examiner*—Edgar S. Burr
*Assistant Examiner*—Joseph McCarthy
*Attorney, Agent, or Firm*—Bachman & LaPointe

[57] ABSTRACT

An arch support for the foot includes a plantar support member having a cavity to removably receive a metatarsal support element; metatarsal support elements of different height can be used depending on the activity engaged in by the wearer; heel wedges of different height may similarly be used; the metatarsal support element has, in particular, an open lattice-like structure which reduces material and weight of the support, improves flexibility and allows better air circulation.

13 Claims, 1 Drawing Sheet

ARCH SUPPORT

BACKGROUND OF THE INVENTION a. Field of the Invention

This invention relates to an orthopaedic arch support.

b. Description of the Prior Art

Various types of arch support are in use for support of the foot. Such supports are worn within the shoe and provide support for different parts of the foot and may be used to correct the shape of the foot, and to maintain the proper shape of the foot during movement.

Canadian Pat. No. 823,869, G. Alzner, issued Sept. 30, 1969, describes a unitary arch support which has proved successful and which provides support for both the plantar arch and the metatarsal arch of the foot.

SUMMARY OF THE INVENTION

The present invention provides an arch support with significant improvements over that of Alzner, particularly in being more versatile, less rigid, providing greater stability, support and contact, employing less material and permitting a better fit in the shoe of the wearer. The arch support of the invention can be modified by the wearer by use of different component elements having regard to the particular shoe being worn or the activity engaged in.

In accordance with one aspect of the invention there is provided an arch support comprising: a plantar support member of a resilient biomedically compatible plastic. The plantar support member is adapted to extend from the heel to the ball of the foot of the wearer. The plantar support member has a first surface adapted to be disposed in facing relationship with the plantar of the wearer, and a second surface opposed to the first surface. A cavity is defined in the second surface having a cavity floor adapted to be disposed in opposed relationship with the metatarsal of the wearer. A flexible metatarsal element is adapted to be received in the cavity.

In one embodiment of the invention there is provided an arch support assembly which comprises the plantar support member and a plurality of the flexible metatarsal elements, each of different height as well as a plurality of heel wedges, each of different height, the heel wedges each being adapted to be temporarily secured to a heel of the plantar support member.

Other aspects of the invention include the plantar support member per se as a component of the arch support; and the metatarsal element per se as a component of the arch support.

BRIEF DESCRIPTION OF THE DRAWINGS

The invention is illustrated in an especially preferred embodiment with reference to the accompanying drawing in which.

DESCRIPTION OF THE PREFERRED EMBODIMENT WITH REFERENCE TO THE DRAWINGS

Figure 1:
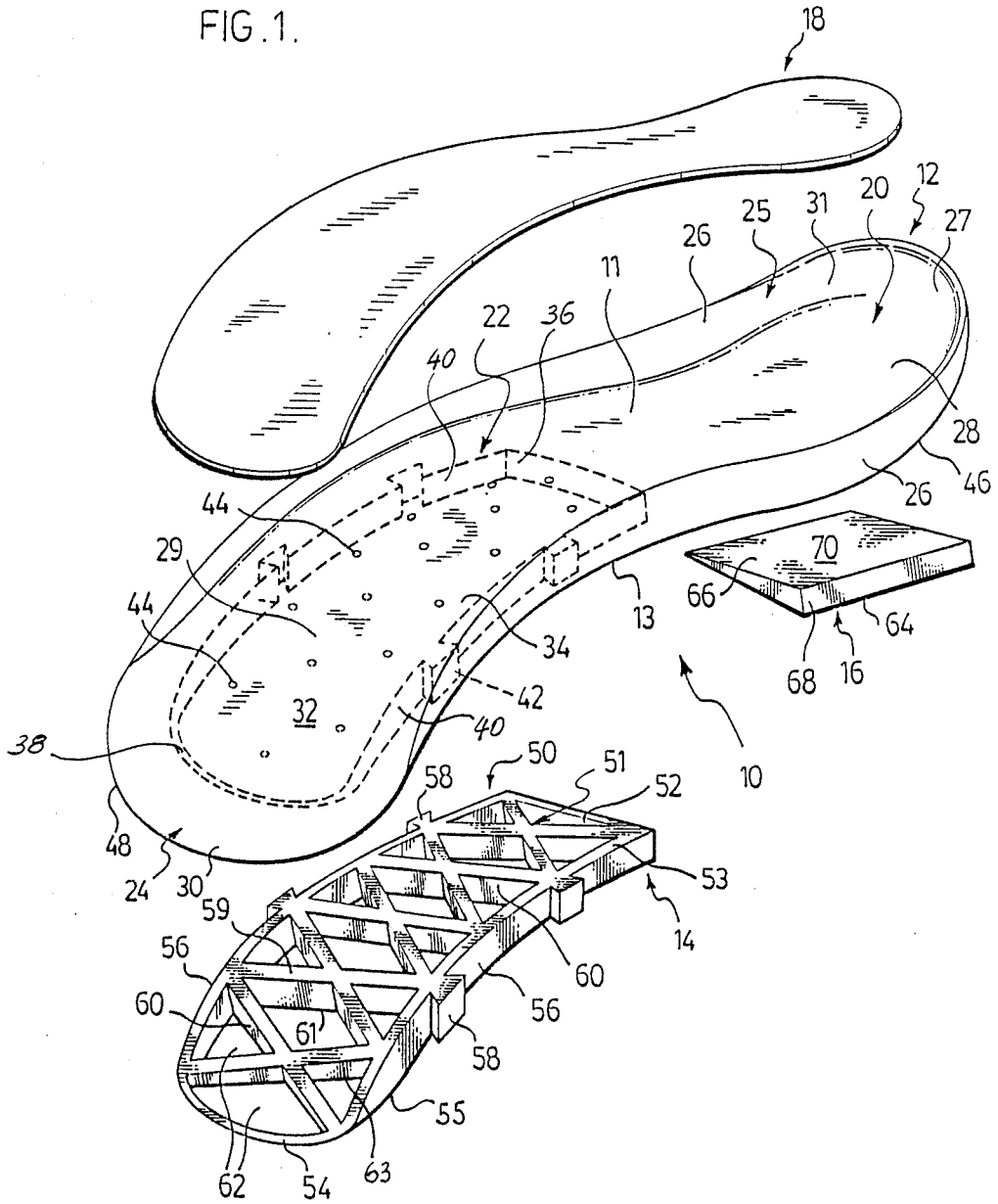
FIG. 1 shows an exploded view of an arch support of the invention.

With further reference to FIG. 1, there is shown an arch support 10 comprising a plantar support 12 having a plantar support surface 11 and an opposed surface 13, a removable metatarsal element 14, a heel wedge 16 and a cushioning cover 18.

The plantar support 12 includes a heel region 20, a metatarsal region 22 and a front region 24, and as can be seen, has an upwardly convex curvature in the longitudinal direction.

The plantar support 12 is of greatest depth between surfaces 11 and 13 in the metatarsal region 22. The plantar support 12 is thinner in the heel region 20 and is thinnest in the front region 24.

A wing 25 extends upwardly and outwardly along the periphery of the metatarsal region 22 and the heel region 20, and includes opposed metatarsal portions 26 and a heel portion 27. Together with the heel region 20, the heel portion 27 forms a dish-shaped zone 28. The metatarsal portions 26 merge remote from the heel region 20 with a thin lip 30, in front region 24.

A cavity 32 extends inwardly of opposed surface 13 in the underside of metatarsal region 22. Cavity 32 includes an upwardly convexly curved cavity floor 34, a cavity rear wall 36, a cavity front wall 38 and cavity side walls 40 extending between the front and rear walls 36 and 38, respectively.

A plurality of slots 42 extend transversely of cavity 32 in side walls 40.

A plurality of spaced apart orifices 44 extend through cavity floor 34 and plantar support surface 11.

Heel region 20 includes a non-skid surface 46 on surface 13, which may be formed by roughening the surface 13.

A non-skid surface 48 is similarly formed on the surface 13 at the underside of thin lip 30.

The removable metatarsal element 14 has an outer frame 50 comprising a rear wall 52, a front wall 54 and side walls 56. Frame 50 has an upper face 53 and a lower face 55.

A plurality of projections 58 extend outwardly of side walls 56, and extend from face 53 to face 55.

A lattice-like structure 51 is formed in frame 50 by struts 60 which intersect or cross to define openings 62 between adjacent struts 60 and between struts 60 and walls 52, 54 and 56 of frame 50, respectively.

The struts 60 each have an upper face 59, a lower face 61 and opposed side faces 63 extending between faces 59 and 61. The opposed faces 63 of each strut 60 are inclined inwardly from upper face 59 to lower face 61. In this way, struts 60 taper inwardly from top to bottom.

The upper faces 59 of struts 60 and the upper face 53 of frame 50 are adapted to mate with cavity floor 34 of plantar support member 12.

Heel wedge 16 has a base 64, a sloping top wall 66 and an end wall 68. Heel wedge 16 is suitably provided with non-skid surfaces 70.

In use, the removable metatarsal element 14 is fitted into cavity 32 by pushing or sliding projections 58 into the corresponding slots 42 in the side walls 40 of cavity 32, so that upper walls 59 of struts 60 are in opposed facing relationship with cavity floor 34.

A heel wedge 16 is secured to a non-skid surface 46 of plantar support 12, for example, with an adhesive tape. The non-skid surface 70 of heel wedge 16 provides for secure adhesion of heel wedge 16 to the non-skid surface 46 of heel region 20.

The cover 18, which represents an optional component of the arch support 10, is suitably of a vinyl plastic or leather and is most suitably pressure-molded onto the plantar surface 11 of the plantar support 12, to provide added foot comfort.

In accordance with the invention, the arch support 10 is most suitably marketed with different removable metatarsal elements 14 and different heel wedges 16, so that the arch support 10 can be modified by the wearer having regard to the footwear being worn, and the activity being engaged in.

Typically the arch support 10 will be available with mechanical elements 14 having three different heights, namely low, medium and normal. The low-height metatarsal element is especially suitable for use during running or jogging; the medium-height metatarsal element is especially appropriate for sports activities; and the normal metatarsal element is intended for normal walking or foot correction.

In accordance with the invention a removable metatarsal element 14 is readily snapped into place in the plantar support 12 but can be readily removed for cleaning or replacement by a metatarsal element 14 of a different height. When snapped into place, the metatarsal element 14 will float, or slide inwardly and outwardly of cavity 32 in accordance with the movement of the foot and increases the flexibility of the metatarsal support provided.

The open lattice-like structure of the metatarsal element 14 makes the arch support 10 less rigid and more bendable or flexible, which is particularly important for more strenuous activities, such as running, jogging and sports.

This open structure and also the taper of the struts 60 reduces the amount of material used in the manufacture, and consequently reduces the weight of the arch support 10. The upper faces 59 of struts 60 provide an enlarged support surface for the cavity floor 34.

The lattice-like structure of metatarsal element 14 and the resulting increase in flexibility, is found to provide better contour and contact with the plantar surface of the foot to give greater stability and to permit less rotation of the foot in clockwise or anti-clockwise direction, which is particularly significant when the wearer is running.

The dish-shaped zone 28 is adapted to accommodate the heel of the foot and the opposed metatarsal portions 26 of wing 25 serve to locate the foot on the plantar support 12 and prevent transverse movement of the arch support 10 with respect to the foot in use. The thin lip 30 is adapted, when arch support 10 is correctly fitted, to extend up to but not past the ball of the foot.

In the metatarsal region 22, the plantar support 12 has on its upper side, defined by plantar support surface 11, a raised, generally convexly curved zone 29 which extends longitudinally the length of the metatarsal region 22, and transversely between the opposed metatarsal portions 26 of wing 25. Hollows or troughs 31 are defined between the metatarsal portion 26 and zone 29. As indicated above, the depth of arch support 10 is greatest in this area and appropriate support is provided for the metatarsal arch.

In particular, the second, third and fourth metatarsal bones are supported by zone 29, and the first and fifth metatarsal bones are accommodated in the hollows or troughs 31.

The arch support 10 is provided in the longitudinal direction with a significant upward curvature in both the plantar support surface 11 and the opposed surface 13. The curvature in opposed surface 13 is embodied in the lower side of metatarsal element 14 defined by lower walls 61 of struts 60.

Although the metatarsal element 14 is described as a removable element, it will be evident that it could be adhered or secured permanently in cavity 32 of plantar support 12.

It is similarly envisaged that arch support 10 will be available with a plurality of heel wedges 16 of different sizes. For example, it is anticipated that the heel wedges 16 will be available with end walls 68 having heights of 1/32, 1/16, ⅛ and ¼ of an inch. In this way, an appropriate heel wedge 16 can be selected depending on the amount of degrees necessary, to correct various heel or forefoot rotation, prescribed by a qualified foot technician. After application to the non-skid surface 46 of the heel region 20, the heel wedge 16 is trimmed to the contour of the plantar support.

The orifices 44, which extend through cavity floor 34 of plantar support 12, permit circulation or breathing of the arch support 10.

The orifices 44 are located so as to communicate with the openings 62 in the metatarsal element 14, and in this way, air is trapped in pockets defined by the openings 62 between the foot and the shoe insole, and such pockets of air act as shock absorbers to relieve stress on the foot and body. The pockets of air also serve to regulate foot-body temperature during variable exterior or outside temperature.

As compared with the Alzner arch support of Canadian Pat. No. 823,869, the structure of the arch support 10 of the present invention permits the width of the arch support to be less than an Alzner arch support of comparable size, and also permits a thinner front. This provides better fit in footwear and also lessens stretching of the material of the footwear above the sole of the shoe. The narrower width provided by the structure of the present invention as compared with that of Alzner also allows more space for the foot in the instep of the footwear.

By way of example, in a man's size 8 arch support of the Alzner structure, the thickness of the front end is two millimeters, whereas the corresponding arch support 10 of the present invention has a thin lip 30 with a thickness of only one millimeter. The Alzner arch support has a maximum width across the metatarsal region of eight millimeters, whereas the comparable width in the arch support 10 of the present invention is only 7.6 millimeters. The Alzner arch support has a minimum width in the metatarsal region of 7 millimeters, whereas the comparable width in an arch support 10 of the present invention is 6.8 millimeters. The total length of a size 8 man's arch support in the Alzner structure is 17.4 millimeters, whereas a corresponding sized arch support 10 in accordance with the present invention has a length of 17.3 millimeters.

The plantar support 12, the metatarsal element 14 and the heel wedge 16 in accordance with the present invention are suitably injectionmolded from an acceptable plastic material. In particular, the plastic should be biomedically compatible in an arch support, by which is meant that it should be inert and not harm or irritate the foot or the skin in any way; it should be relatively firm but nevertheless resilient and flexible so as to possess a memory of its molded shape over a temperature range which might be encountered in use. An especially preferred polymer for injection-molding the arch support is ethylene vinyl acetate.

The use of EVA and similar materials for the construction, results in an arch support, in accordance with the invention, which can be cleaned or washed daily, without destroying the structure or function; the arch support is thus sanitary.

The arch support of the invention will fit readily into standard footwear, the "standard" being set by shoe manufacturers around the world.

We claim:

1. A plantar support member for use in an arch support, said member being molded of resilient biomedically compatible plastic and adapted to extend from the heel to the ball of the foot of a wearer, said member having a first surface adapted to be disposed in facing relationship with the plantar of the wearer, and a second surface opposed to said first surface, and a cavity defined in said member and extending inwardly from said second surface, said cavity having opposed cavity side walls, a cavity floor and a plurality of spaced apart slot means in said cavity side walls extending from said cavity floor to said second surface, said cavity floor being located to be disposed in opposed relationship with the metatarsal of the wearer.

2. A plantar support member according to claim 1, wherein said plantar support member has a heel region, a metatarsal region and a front region; an upwardly, outwardly extending wing around the outer periphery of said metatarsal and heel regions and terminating in a thin forwardly extending lip portion of said front region, said wing comprising a heel portion and opposed metatarsal portions, said heel portion and said heel region of said plantar support member being adapted to accommodate the heel of the foot of a wearer; said wing being adapted to limit movement of the arch support with respect to the foot when worn.

3. A plantar support member according to claim 11, wherein said slot means are wedge-shaped.

4. An arch support comprising in combination:

a plantar support member of resilient biomedically compatible plastic adapted to extend from the heel to the ball of the foot of a wearer, said support member having a first surface adapted to be disposed in facing relationship with the plantar of the wearer, and a second surface opposed to said first surface, a cavity defined in said second surface, said cavity having opposed cavity side walls, a cavity floor, and a first plurality of spaced apart slot means in said cavity side walls extending from said cavity floor to said second surface, said cavity floor being adapted to be disposed in opposed relationship with a metatarsal of the wearer, a flexible metatarsal support element having an upper face and a lower face, said flexible metatarsal support element comprising a frame with opposed frame side walls and a plurality of intersecting struts extending between said frame side walls to form an open lattice-like structure, a second plurality of spaced apart projections extending outwardly of said frame side walls each projection of said second plurality being adapted to be slidingly received within a corresponding slot means of said first plurality such that said flexible metatarsal support element is slidingly receivable in said cavity, said lattice-like structure comprising open passages extending from said upper face to said lower face.

5. An arch support according to claim 4, wherein said plantar support member has a heel region, a metatarsal region and a front region; an upwardly, outwardly extending wing around the outer periphery of said metatarsal and heel regions and terminating in a thin forwardly extending lip portion of said front region, said wing comprising a heel portion and opposed metatarsal portions, said heel portion and said heel region of said plantar support member being adapted to accommodate the heel of the foot of a wearer; said wing being adapted to limit movement of the arch support with respect to the foot when worn.

6. An arch support according to claim 5, including a heel wedge adapted to be secured to said second surface in said heel region of said plantar support member.

7. An arch support according to claim 4, further including a cushioning cover pressure molded to said first surface for added foot comfort.

8. An arch support according to claim 4, wherein said struts have top faces forming part of said upper face and bottom faces forming part of said lower face, each of said struts being tapered inwardly from its top face to its bottom face whereby said top faces provide an enlarged support surface for said cavity floor.

9. An arch support according to claim 8, wherein said slot means of said first plurality are wedge-shaped slots and said projections of said second plurality are correspondingly wedge-shaped to mate with the wedge-shaped slots.

10. An arch support according to claim 9, further including a plurality of orifices in said plantar support member, each of said orifices extending through said first surface and cavity floor; said open passages communicating at said upper face with said orifices.

11. An arch support assembly comprising in combination:

a plantar support member of resilient biomedically compatible plastic adapted to extend from the heel to the ball of the foot of a wearer, said support member having a first surface adapted to be disposed in facing relationship with the plantar of the wearer, and a second surface opposed to said first surface, a cavity defined in said plantar support member and extending inwardly from said second surface, said cavity having opposed cavity side walls, a cavity floor adapted to be disposed in opposed relationship with the metatarsal of the wearer, and a plurality of spaced apart slot means in said cavity side walls extending from said cavity floor to said second surface, a plurality of flexible metatarsal support elements, each having an upper face and an opposed lower face and each of different height, adapted to be removably received in said cavity for floating movement inwardly and outwardly thereof, each flexible metatarsal support element of said plurality comprising a frame and a plurality of intersecting struts extending between opposed sides of said frame to form an open lattice-like structure, said open lattice-like structure comprising open passages extending from said upper face to said lower face, a second plurality of spaced apart projections extending outwardly of said opposed sides, each projection of said second plurality being adapted to be slidingly received within a corresponding slot means of said cavity side walls, and a plurality of heel wedges, each of different height, adapted to be secured to said second surface in a heel region of said plantar support member.

12. An arch support assembly according to claim 11, wherein said open passages of said lattice-like structure communicate at said upper face with a plurality of orifices, each of said orifices extending through said first surface and said cavity floor of said plantar support member.

13. An assembly according to claim 11 further including a cushioning cover pressure molded to said first surface for added foot comfort.

* * * * *